US010859230B2

(12) United States Patent
Paroni et al.

(10) Patent No.: US 10,859,230 B2
(45) Date of Patent: Dec. 8, 2020

(54) AUTOMOTIVE LIGHTING UNIT WITH A LIGHT GUIDE PLATE

(71) Applicant: Automotive Lighting Italia S.p.A., Venaria Reale (IT)

(72) Inventors: Sara Paroni, Codroipo (IT); Alessandro Sacca', Tolmezzo (IT); Marco Svettini, Tolmezzo (IT)

(73) Assignee: Automotive Lighting Italia S.p.A., Venaria Reale (IT)

( * ) Notice: Subject to any disclaimer, the term of this patent is extended or adjusted under 35 U.S.C. 154(b) by 262 days.

(21) Appl. No.: 16/089,916

(22) PCT Filed: Mar. 31, 2017

(86) PCT No.: PCT/IB2017/051864
§ 371 (c)(1),
(2) Date: Sep. 28, 2018

(87) PCT Pub. No.: WO2017/168387
PCT Pub. Date: Oct. 5, 2017

(65) Prior Publication Data

US 2020/0300436 A1 Sep. 24, 2020

(30) Foreign Application Priority Data

Mar. 31, 2016 (IT) ..... 102016000033194

(51) Int. Cl.
*F21S 43/239* (2018.01)
*F21S 43/14* (2018.01)
(Continued)

(52) U.S. Cl.
CPC ..... *F21S 43/239* (2018.01); *F21S 43/14* (2018.01); *F21S 43/241* (2018.01);
(Continued)

(58) Field of Classification Search
CPC ..... F21S 43/239; F21S 43/249; F21S 43/14; F21S 43/243; F21S 43/241
See application file for complete search history.

(56) References Cited

U.S. PATENT DOCUMENTS

2008/0013333 A1* 1/2008 Koizumi ..... B60Q 1/2696 362/511
2013/0021815 A1 1/2013 Koizumi
(Continued)

FOREIGN PATENT DOCUMENTS

EP 1895228 3/2008
EP 2530372 12/2012
(Continued)

OTHER PUBLICATIONS

PCT International Search Report and Written Opinion for PCT/EP2017/051864 dated Aug. 22, 2017.

*Primary Examiner* — Isiaka O Akanbi
*Assistant Examiner* — Nathaniel J Lee
(74) *Attorney, Agent, or Firm* — McCarter & English, LLP

(57) ABSTRACT

Automotive lighting unit comprising a first lighting assembly able to backlight a transparent or semi-transparent portion of the front half-shell; the lighting assembly comprising: at least one light-guide plate made of photoconductive material, which is arranged inside the rear casing with a front sidewall of the plate facing the transparent or semi-transparent portion, and with a rear sidewall of the plate facing the rear casing; a first oblong light source which is located inside the rear casing at a first segment of the rear sidewall, and is capable of directing the light produced inside the light-guide plate so that the light travels inside the body of the light-guide plate towards the front sidewall; and a second light source which is located inside the rear casing at a second segment of the rear sidewall complementary to
(Continued)

the first segment, and is capable of directing the light produced inside the light-guide plate, so that this light travels inside the body of the light-guide plate towards a first lateral sidewall of the light-guide plate connecting the second segment of the rear sidewall of the light-guide plate to the front sidewall of the same light-guide plate. The light-guide plate is provided with a transversal groove that extends along one of the two faces of the light-guide plate, from the front sidewall of the light-guide plate towards the rear sidewall of the light-guide plate, so as to be interposed between the first lateral sidewall of the plate and the front sidewall of the plate, and is crossed by the light reflected by the first lateral sidewall of the light-guide plate towards the front sidewall of the light-guide plate.

16 Claims, 4 Drawing Sheets

(51) Int. Cl.
*F21S 43/243* (2018.01)
*F21S 43/249* (2018.01)
*F21S 43/241* (2018.01)
*F21Y 105/16* (2016.01)

(52) U.S. Cl.
CPC ..... *F21S 43/243* (2018.01); *F21S 43/249* (2018.01); *F21Y 2105/16* (2016.08)

(56) References Cited

U.S. PATENT DOCUMENTS

2015/0049503 A1* 2/2015 Paroni ..... F21S 43/239
362/511
2015/0277027 A1* 10/2015 Koizumi ..... F21S 43/14
362/511

FOREIGN PATENT DOCUMENTS

EP 2840300 2/2015
JP 2013073687 4/2013
WO WO 2015/075668 A1 5/2015

* cited by examiner

AUTOMOTIVE LIGHTING UNIT WITH A LIGHT GUIDE PLATE

CROSS-REFERENCE TO RELATED APPLICATIONS

This application is a 35 U.S.C. § 371 National Stage filing of International Application No. PCT/IB2017/051864, filed on Mar. 31, 2017, which claims priority to Italian Patent Application 102016000033194, filed on Mar. 31, 2016.

TECHNICAL FIELD

The invention relates to an automotive lighting unit.

In particular, the invention relates to a rear light for cars, to which explicit reference will be made in the description below without because of this loosing in generality.

BACKGROUND ART

As it is known, automotive rear lights usually comprise: a substantially basin-shaped rear casing, which is structured so as to be steadily fitted into a compartment especially obtained in the rear part of the body of the vehicle; of a front half-shell, which is arranged to close the mouth of the casing so as to project outwards from the body of the vehicle, and is provided with a series of transparent or semi-transparent portions, usually with colours that are different from one another; and a series of lighting assemblies, which are located inside the casing, each immediately under a respective transparent or semi-transparent portion of the front half-shell, so as to backlight the same transparent or semi-transparent portion of the front half-shell.

Generally speaking, each lighting assembly is univocally associated with a specific light signal and, therefore, it is structured so as to emit a light beam that, after having left the automotive light through the front half-shell, complies with the enforced homologation standards concerning said light signal.

Over the past few years, some car manufacturers have chosen to equip their new car models with rear lights in which the front half-shell is provided with at least one transparent or semitransparent portion having a narrow and long shape, namely substantially ribbon-like, which is arranged horizontally when the automotive light is fitted on the vehicle, and is usually associated with the blinking light signal indicating direction/turn.

Currently, each transparent or semi-transparent ribbon-like portion of the half-shell is backlighted by a lighting assembly, which basically comprises: a large light-guide plate made of a photoconductive material, which is located inside the rear casing with the front sidewall grazing the transparent or semi-transparent ribbon-like portion of the front half-shell, substantially on the entire length of the transparent or semitransparent ribbon-like portion itself, and with the rear sidewall facing the bottom of the rear casing; and a row of LED diodes, which are located on the bottom of the rear casing, striking against the rear sidewall of the light-guide plate, and are oriented so as to direct the light produced directly inside the body of the light-guide plate. Said light propagates inside the body of the light-guide plate, thus streaming out of the light-guide plate through the front sidewall of the plate.

Unfortunately, the light-guide plate usually has a significant width, thus making it very difficult for manufacturers to reduce the depth of the automotive lighting unit.

In order to avoid this drawback, some manufacturers of automotive lights have shortened the rear sidewall of the light-guide plate and have positioned the group of LED diodes in such a way that they strike against the end segment of the rear sidewall of the plate, so as to direct the light produced towards the adjacent and contiguous lateral sidewall of the plate, which, in turn, is adapted to reflect the incident light towards the front sidewall of the light-guide plate.

By so doing, the light produced by this small group of LED diodes reaches the front sidewall of the light-guide plate following an optical path that has a length that is substantially equal to the one of the optical path followed by the light emitted by the LED diodes striking against the rest of the rear sidewall of the light-guide plate.

Unfortunately, experiments have shown that a small part of the light emitted by this group of LED diodes, after having penetrated the body of the light-guide plate, manages to directly reach the front sidewall of the light-guide plate, thus streaming out of a small portion of the front sidewall that is immediately adjacent to the vertex joining the latter to the lateral sidewall of the plate. As a consequence, this small segment of the front sidewall of the light-guide plate has a visibly greater luminosity than the rest of the front sidewall of the plate.

Therefore, the light streaming out of the light-guide plate does not have a uniform intensity along the entire length of the front sidewall of the plate, with all the consequent problems affecting the quality of the backlighting of the corresponding transparent or semi-transparent ribbon-like portion of the front half-shell. As a matter of fact, a light signal with an intensity that changes too much along the front half-shell is considered to be not good-looking for an observer and, of course, is highly undesired by car manufacturers.

DISCLOSURE OF INVENTION

The object of the invention is so eliminate the negative effects due to the presence of the group of LED diodes facing the lateral sidewall of the light-guide plate, though without reducing the intensity of the light streaming out of the front sidewall of the light-guide plate parallelly to the main optical axis of the lighting unit.

Therefore, the invention provides an automotive lighting unit according to claim 1 and preferably, but not necessarily, according to any one of the claims depending on it.

BRIEF DESCRIPTION OF THE DRAWINGS

The invention will now be described with reference to the accompanying drawings, which show a non-limiting embodiment thereof, wherein:

FIG. 5 is a side view of the lighting assembly shown in FIG. 4, with a cross section along section line A-A and with parts removed for greater clarity; whereas

BEST MODE FOR CARRYING OUT THE INVENTION

Figure 1:
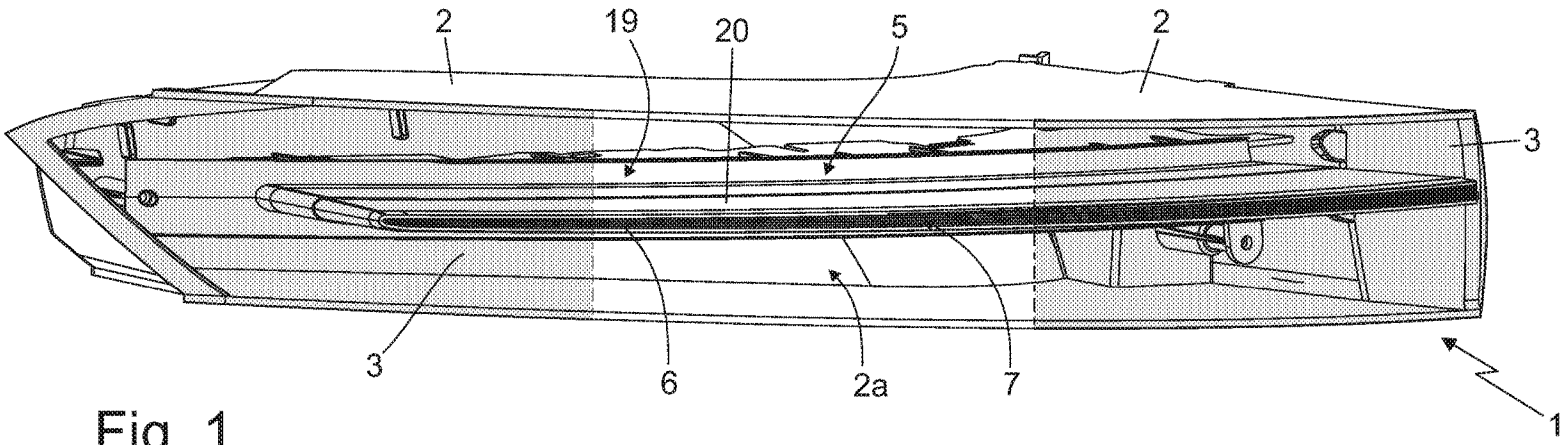
FIG. 1 is a perspective view of an automotive rear light according to the invention, with cross-sectional parts and parts removed for greater clarity.
Figure 2:
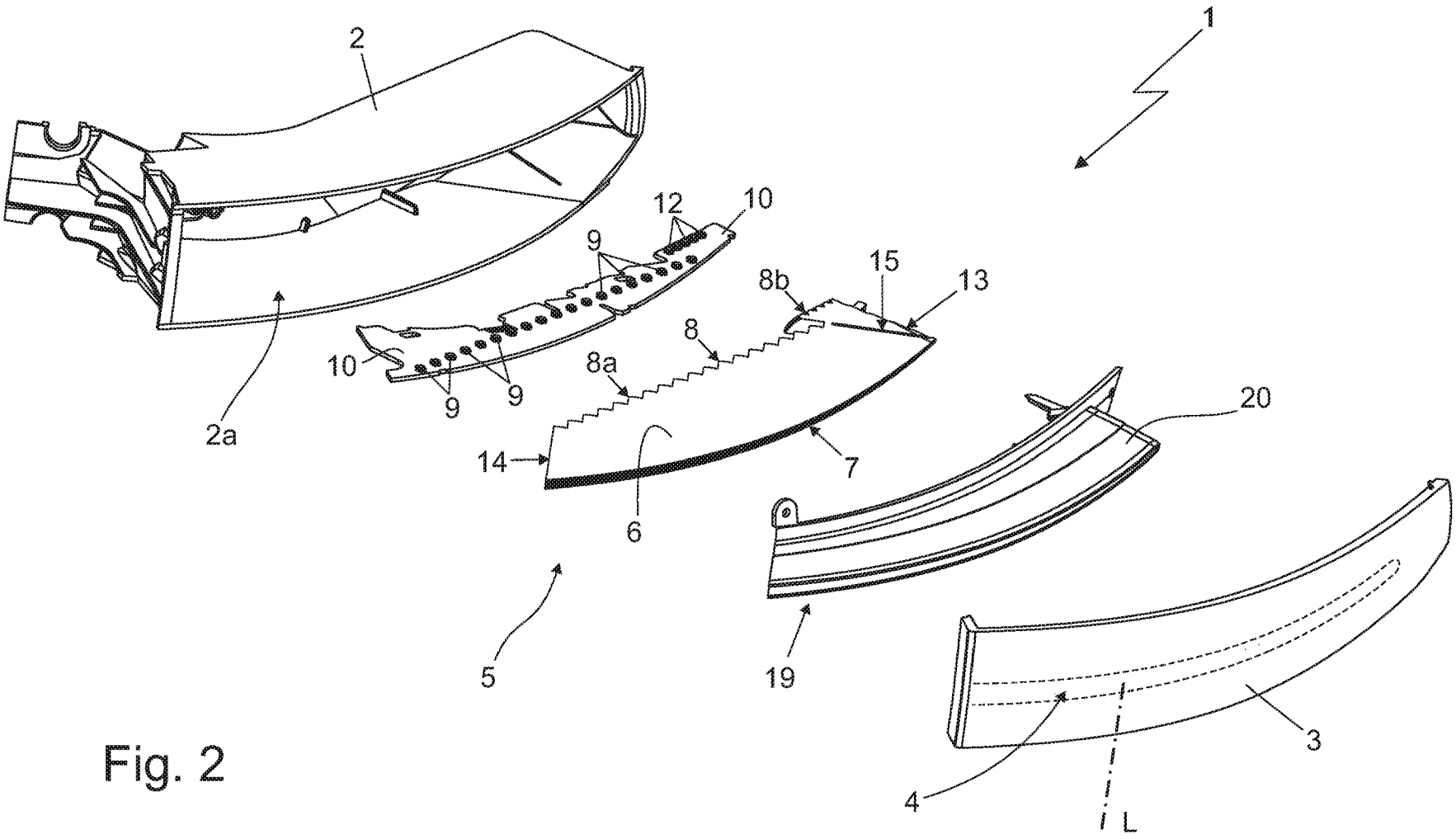
FIG. 2 is a partially exploded, perspective view of the automotive lighting unit shown in FIG. 1, with parts removed for greater clarity.

With reference to FIGS. 1 and 2, number 1 indicates, as a whole, an automotive lighting unit, which is especially suited to be fitted in the front or rear part of the body of a car, van, truck, motorcycle or the like, i.e. an automotive front or rear light.

In the example shown, in particular, the automotive lighting unit 1 is preferably structured so as to be steadily fitted into the rear part of the body of a car or a similar motor vehicle.

More in detail, the automotive lighting unit 1 comprises, first of all: a stiff rear casing 2, which is preferably made of a plastic material, is substantially basin-shaped, and is preferably structured so as to be at least partially fitted into a seat, which is especially obtained in the rear part of the body of the vehicle (not shown); a stiff front half-shell 3, which is preferably made of a plastic material, is arranged to close the mouth 2*a* of the rear casing 2, preferably so as to be able to simultaneously project outwards from the body of the vehicle, and is provided with one or more transparent or semi-transparent, optionally even coloured, portions; and one or more electrically powered lighting assemblies, each emitting light on command and located inside the rear casing 2 in a position that is such as to allow them to backlight a corresponding transparent or semitransparent portion of the front half-shell 3, preferably separately from and independently of the other lighting assemblies.

Obviously, in a different embodiment, the rear casing 2 could be designed so as to be simply fixed in a projecting manner on the rear part of the body of the vehicle (not shown).

In addition, the automotive lighting unit 1 is provided with a main optical axis, which is parallel to the longitudinal axis of the vehicle when the automotive lighting unit 1 is correctly positioned/fixed on the body of the vehicle, and one or more of said lighting assemblies is/are preferably structured so as to project the light outwards from the automotive lighting unit 1 with a prevailing component that is parallel to the main optical axis L of the lighting unit.

More in detail, with reference to FIGS. 1 and 2, at least one of transparent or semi-transparent portions of the front half-shell 3, hereinafter indicated with number 4, preferably has a narrow and long shape, namely a substantially ribbon-like shape, and is preferably located on the front half-shell 3 so as to substantially extend horizontally when the automotive lighting unit 1 is fitted on the vehicle.

On the other hand, the lighting assembly, which is adapted to backlight the transparent or semi-transparent ribbon-like portion 4 of the lenticular half-shell 3, hereinafter indicated with number 5, is located inside the rear casing 2 immediately under the transparent or semi-transparent ribbon-like portion 4, so as to directly face the transparent or semi-transparent ribbon-like portion 4, and is structured so as to direct the light produced towards the transparent or semi-transparent ribbon-like portion 4.

Preferably, the lighting assembly 5 is further structured so as to project the light outwards from the automotive lighting unit 1 through the transparent or semi-transparent ribbon-like portion 4 with a prevailing component that is parallel to the main optical axis L.

In the embodiment shown, in particular, the rear casing 2 is preferably made of an opaque plastic material, and is preferably manufactured by means of an injection moulding procedure. The front half-shell 3, on the other hand, is preferably made of a transparent or semi-transparent plastic material, such as transparent or semi-transparent polycarbonate or polymethyl methacrylate, and is also preferably manufactured by means of an injection moulding procedure.

With reference to FIGS. 1 to 6, the lighting assembly 5 comprises, in turn: at least one light-guide plate 6 of photoconductive material, preferably made of a transparent plastic material, which is arranged inside the rear casing 2 with its front sidewall 7 substantially coplanar to and directly facing the transparent or semi-transparent ribbon-like portion 4 of the front half-shell 3, preferably substantially along the entire length of the transparent or semi-transparent ribbon-like portion 4, and with its rear sidewall 8 facing the bottom of the rear casing 2; and an electrically powered oblong light source, which extends inside the rear casing 2 in the area of or close to a first segment 8*a* of the rear sidewall 8 of the light-guide plate 6, and is capable of directing the light produced directly inside the body of the light-guide plate 6 substantially along the entire length of the segment 8*a*. The light then propagates inside the light-guide plate 6, due to the same physical principles that control the propagation of light inside optical fibres, and streams out of the light-guide plate 6 through the front sidewall 7 of the plate directed towards the transparent or semi-transparent ribbon-like portion 4 of the front half-shell 3.

More in detail, the front sidewall 7 of the light-guide plate 6 is preferably arranged so as to locally be tangent to/graze the transparent or semi-transparent ribbon-like portion 4 of the front half-shell 3, preferably substantially along the entire length of the transparent or semi-transparent ribbon-like portion 4.

With reference to FIGS. 1 and 2, the guide-light plate 6 preferably further extends inside the rear casing 2 remaining substantially locally perpendicular to the transparent or semi-transparent ribbon-like portion 4 of the front half-shell 3. In addition, the lying plane of the light-guide plate 6 is also preferably substantially parallel to the main optical axis L of the automotive lighting unit.

Figure 3:
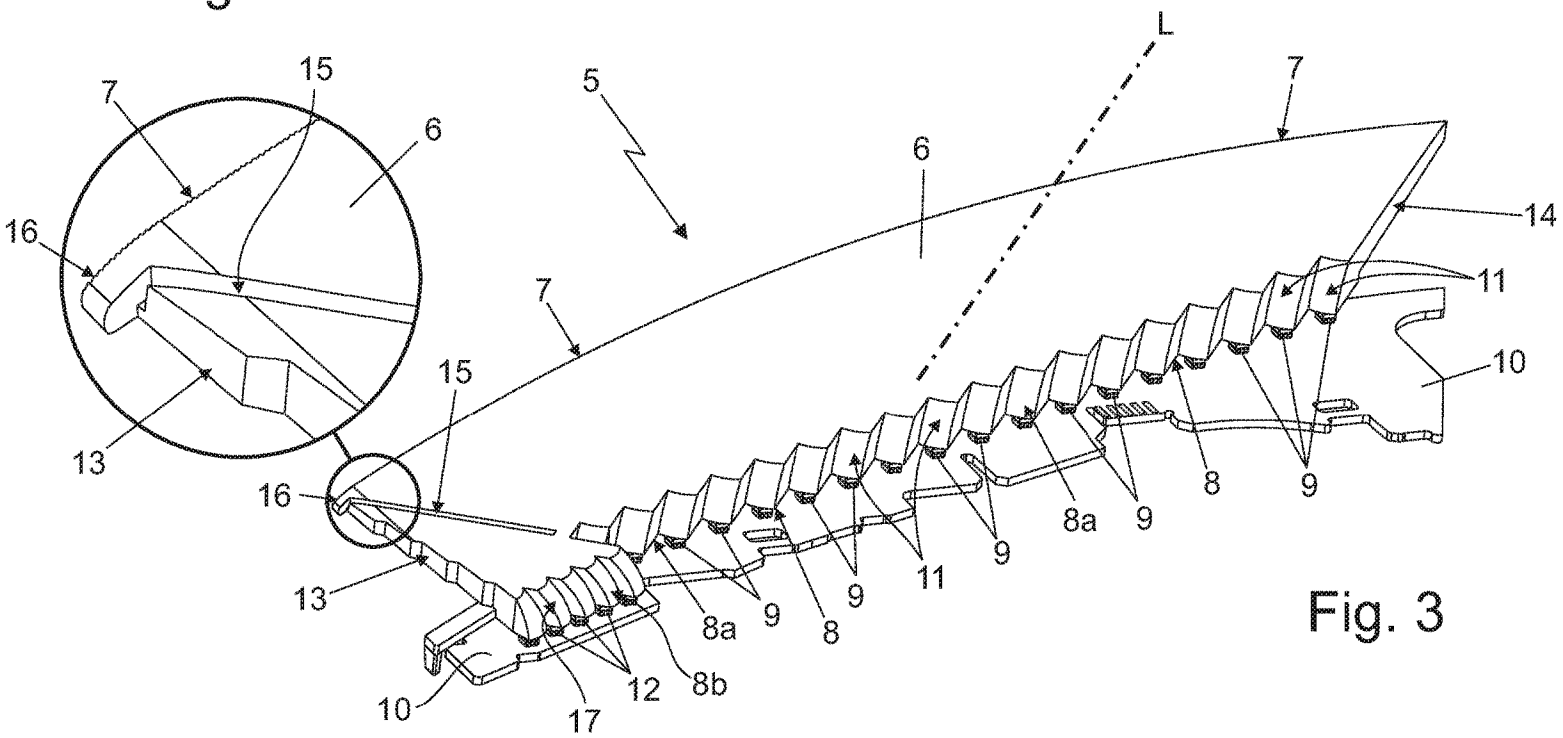
FIGS. 3 and 4 are, respectively, a plan view and a perspective view of the lighting assembly of the automotive lighting unit shown in FIG. 1, with parts removed for greater clarity.
Figure 6:
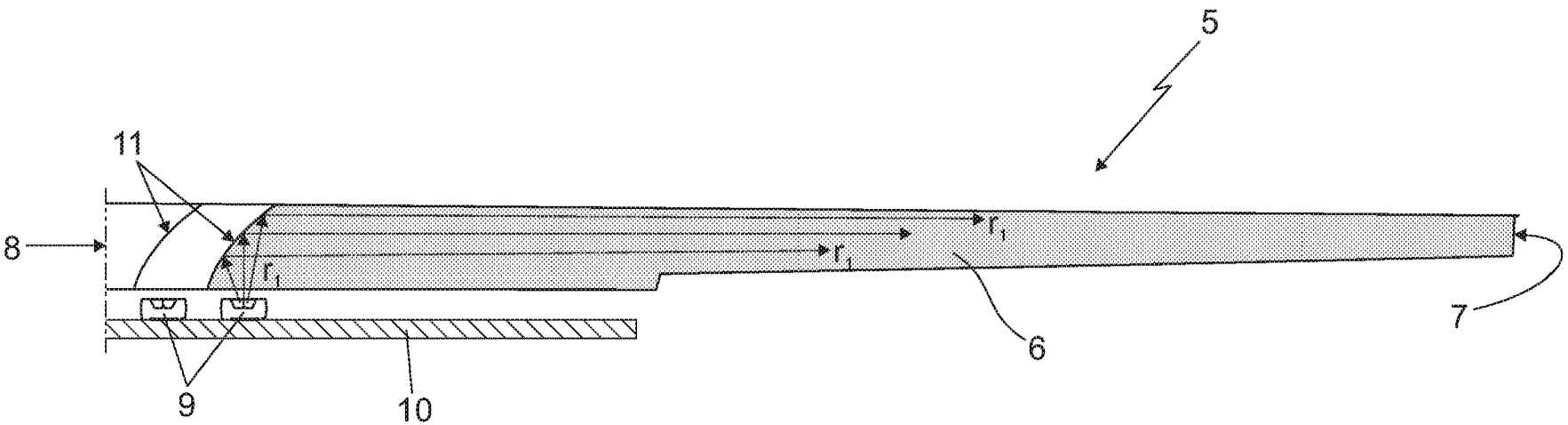
FIG. 6 is a side view of the lighting assembly shown in FIG. 4, with a cross section along section line B-B and with parts removed for greater clarity.

With reference to FIGS. 2, 3 and 6, on the other hand, the oblong light source is capable of emitting light on command and it preferably comprises a row of LED diodes 9 (acronym for Light Emitting Diodes) or other preferably punctiform light sources, which are located inside the rear casing 2 close to the segment 8*a* of the rear sidewall 8 of the light-guide plate 6 and are oriented so as to direct the light produced directly inside the body of the light-guide plate 6.

More in detail, the row of LED diodes 9 extends so as to graze the light-guide plate 6, beside the segment 8*a* of the rear sidewall 8 of the guide-light plate 6, preferably so that the LED diodes 9 face one of the two faces of the light-guide plate 6 and are oriented so as to direct the light produced towards the rear sidewall 8 of the light-guide plate 6, through the face of the light-guide plate 6. The light then reaches the rear sidewall 8 of the light-guide plate 6 with an angle of incidence that is greater than the limit angle, so as to be directly reflected, through total internal reflection, towards the front sidewall 7 of the light-guide plate 6.

In the example shown, in particular, the LED diodes 9 are preferably positioned spaced apart beside one another, on a single support base 10, which preferably incorporates the diode power supply and control circuits and is preferably located inside the rear casing 2 beside and preferably also substantially locally parallel to the light-guide plate 6.

Figure 4:
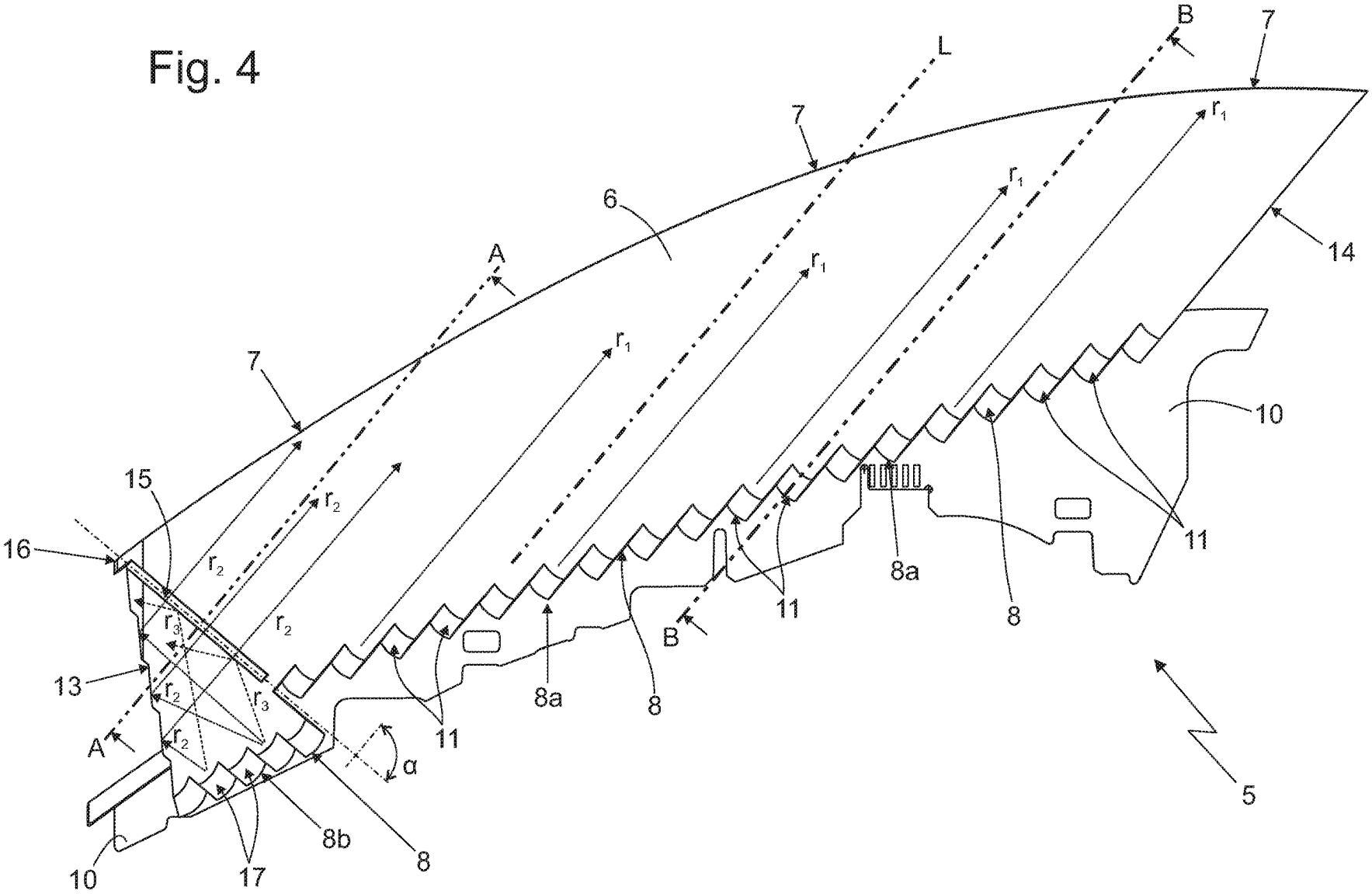
Figure 5:
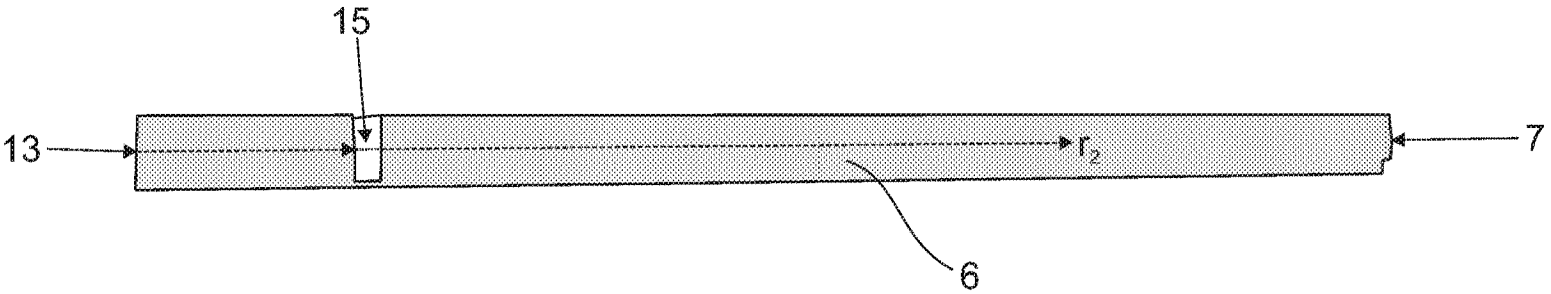

With reference to FIGS. 3, 4 and 6, the segment 8*a* of the rear sidewall 8 of the light-guide plate 6 is preferably further structured/shaped so as to collimate the greatest part of the light rays $r_1$ coming from the LED diodes 9 and reflected towards the front sidewall 7 of the light-guide plate 6, in a direction that is substantially parallel to the main optical axis L of the lighting unit.

More in detail, with reference to FIGS. 2, 3, 4 and 5, in the example shown, the light-guide plate 6 preferably has, along the segment 8*a* of the rear sidewall 8, a series of teeth or protruding projections 11, each provided with a curved surface with a preferably substantially parabolic profile. Each LED diode 9 is preferably located in front of a respective tooth or protruding projection 11, so as to direct the light rays $r_1$ towards the curved surface of the tooth or protruding projection 11, which, in turn, is shaped so as to reflect the light rays $r_1$ towards the front sidewall 7 of the light-guide plate 6, also collimating the greatest part of the light rays $r_1$ in a direction that is substantially parallel to the main optical axis L of the lighting unit.

With reference to FIGS. 2, 3, 4 and 5, the lighting assembly 5 also comprises, in addition, a second electrically powered light source, which is capable of emitting light on command and is located inside the rear casing 2, in the area of or close to a second end segment 8*b* of the rear sidewall 8, which is consecutive and complementary to the segment 8*a*.

The second light source, in addition, is capable of directing the light produced inside the body of the light-guide plate 6 towards a first lateral sidewall of the light-guide plate 6, hereinafter indicated with number 13, which directly connects the end segment 8*b* of the rear sidewall 8 to the front sidewall 7 of the light-guide plate 6. The light then reaches the lateral sidewall 13 of the light-guide plate 6 with an angle of incidence that is greater than the limit angle, so as to be directly reflected, through total internal reflection, towards the front sidewall 7 of the light-guide plate 6, preferably in a direction that is substantially parallel to the main optical axis L of the lighting unit.

Preferably, furthermore, the second light source is an oblong light source, which extends inside the rear casing 2 close to the end segment 8*b* of the rear sidewall 8 and is capable of directing the light produced directly inside the body of the light-guide plate 6 substantially along the entire length of the segment 8*b*.

More in detail, the second light source preferably comprises one or more LED diodes 12 (acronym for Light Emitting Diodes) or other preferably punctiform light sources, which is/are located inside the rear casing 2 close to the segment 8*a* of the rear sidewall 8 of the light-guide plate 6 and is/are oriented so as to direct the light produced directly inside the body of the light-guide plate 6, towards the lateral sidewall 13 of the light-guide plate 6.

With reference to FIGS. 2, 3, 4 and 5, in the example shown, in particular, the lateral sidewall 13 of the light-guide plate 6 preferably has a stepped profile. On the other hand, the second lateral sidewall of the light-guide plate 6, which is opposite to the lateral sidewall 13 and is adapted to directly connect the segment 8*a* of the rear sidewall 8 to the front sidewall 7 of the light-guide plate 6, hereinafter indicated with number 14, is preferably substantially rectilinear and preferably also locally substantially parallel to the main optical axis L of the lighting unit.

With reference to FIGS. 2, 3, 4 and 5, in addition, the light-guide plate 6 is also provided with a preferably substantially rectilinear transversal groove 15, which extends along one of the two faces of the light-guide plate 6, from the front sidewall 7 of the light-guide plate 6 towards the rear sidewall 8 of the light-guide plate 6, so as to be interposed between the lateral sidewall 13 and the front sidewall 7, preferably substantially along the entire width of the light-guide plate 6, and be crossed by the light reflected by the lateral sidewall 13 and directed towards the front sidewall 7 of the light-guide plate 6.

In addition, the transversal groove 15 is also adapted to reflect, through total internal reflection and far from the front sidewall 7 of the light-guide plate 6, the light emitted by the second light source, namely the LED diodes 12, and directed towards the transversal groove 15 (and, hence, towards the front sidewall 7 of the light-guide plate 6) without before reaching the lateral sidewall 13 of the light-guide plate 6 and, here, be reflected towards the front sidewall 7 of the light-guide plate 6.

In other words, the transversal groove 15 is adapted to reflect, far from the front sidewall 7 of the light-guide plate 6, the light directly coming from the second light source, namely from the LED diodes 12, and directed towards the front sidewall 7 of the light-guide plate 6.

More in detail, with special reference to FIGS. 2 and 4, the transversal groove 15 starts from the front sidewall 6 of the light-guide plate 6, preferably in the area of the vertex 16 of the light-guide plate 6 delimited/formed by the front sidewall 7 and by the lateral sidewall 13, and preferably extends towards the joining point between the segment 8*a* and the segment 8*b* of the rear sidewall 8 of the light-guide plate 6.

Preferably, the transversal groove 15 further extends on the face of the light-guide plate 6 until it almost reaches the rear sidewall 8 of the light-guide plate 6, so as to be interposed between the lateral sidewall 13 and the front sidewall 7 of the light-guide plate 6, preferably substantially along the entire width of the light-guide plate 6.

In addition, the transversal groove 15 extends on the face of the light-guide plate 6 with an angle of inclination a, with respect to the main optical axis L of the lighting unit, that is preferably greater than 60°.

More in detail, the transversal groove 15 extends on the face of the light-guide plate 6, while preferably remaining locally substantially perpendicular to the main optical axis L of the lighting unit. Preferably, the transversal groove 15 further has a depth that is always smaller than the thickness of the light-guide plate 6.

In a different embodiment, however, the transversal groove 15 could also be a through groove, which means that is could go through the entire thickness of the light-guide plate 6.

In the embodiment shown, in particular, the light-guide plate 6 is preferably made of transparent polycarbonate or polymethyl methacrylate, and is preferably manufactured by means of an injection moulding procedure. Furthermore, the transversal groove 15 has a depth that preferably ranges from 50% to 95% of the local thickness of the light-guide plate 6.

With reference to FIGS. 2, 3, and 4, the LED diodes 12, instead, are preferably arranged spaced apart beside one another so as to form a row of LED diodes 12, which extends beside the end segment 8*b* of the rear sidewall 8 of the light-guide plate 6.

In addition, similarly to the LED diodes 9, the LED diodes 12 are preferably arranged close to the end segment 8*b* of the rear sidewall 8, facing one of the two faces of the light-guide plate 6, and are oriented so as to direct the light produced towards the rear sidewall 8 of the light-guide plate 6, through the face of the light-guide plate 6. The light then reaches the rear sidewall 8 of the light-guide plate 6 with an angle of incidence that is greater than the limit angle, so as to be directly reflected towards the lateral sidewall 13 of the light-guide plate 6.

More in detail, in the example shown, the LED diodes 12 are preferably arranged spaced apart beside on the another, on the support base 10 that also houses the LED diodes 9.

Preferably, with reference to FIGS. 2, 3 and 4, the end segment 8*b* of the rear sidewall 8 of the light-guide plate 6 is further structured/shaped so as to collimate the greatest part of the light rays $r_2$ coming from the LED diodes and directed towards the lateral sidewall 13, in a predetermined direction that intersects the lateral sidewall 6 with an angle of incidence greater than the limit angle, so as to cause the total reflection of the light rays $r_2$ towards the front sidewall 7 of the light-guide plate 6.

More in detail, in the example shown, the light-guide plate 6 preferably has, along the segment 8*b* of the rear sidewall 8, a second series of teeth or protruding projections 17, each provided with a curved surface with a preferably substantially parabolic profile. Each LED diode is preferably located in front of a respective tooth or protruding projection 17, so as to direct the light rays $r_2$ towards the curved surface of the tooth or protruding projection 17, which, in turn, is shaped so as to reflect the light rays $r_2$ towards the lateral sidewall 13 of the light-guide plate 6, preferably collimating the greatest part of the light rays $r_2$ in a predetermined direction, which intersects the lateral sidewall 13 of the light-guide plate 6 with a predetermined angle of incidence that is greater than the limit angle, so as to cause the total refection of the light rays $r_2$ towards the transversal groove 15 in a second direction that is substantially perpendicular to the transversal groove 15 or, anyway, in a second direction that is such that the light rays $r_2$ reach the transversal groove 15 with an angle of incidence that is smaller than the limit angle.

By so doing, the light rays $r_2$ coming from the lateral sidewall 13 of the light-guide plate 6 can freely cross the transversal groove 15 and go on inside the light-guide plate 6 up to the front sidewall 7 of the light-guide plate 6.

On the other hand, the light rays $r_3$, which come from the LED diode/s 12 and are directly directed towards the transversal groove 15 (namely, are directed towards the front sidewall 7 without before bouncing on the lateral sidewall 13 of the light-guide plate 6), reach the transversal groove 15 with an angle of incidence that is greater than the limit angle and, therefore, are reflected far from the front sidewall 7 of the light-guide plate 6, towards the lateral sidewall 13 of the light-guide plate 6.

Finally, with reference to FIGS. 1 and 2, the lighting assembly 5 preferably comprises also a support structure 19 preferably made of a plastic material, which is located inside the rear casing 2, preferably resting against the bottom of the rear casing 2, and is adapted to hold the light-guide plate 6 and, optionally, even the support base 10 steadily in position under the front half-shell 3.

Preferably, the support structure 19 is further shaped so as to cover/hide some parts of the lighting assembly 5.

More in detail, in the example shown, the support structure 19 is preferably steadily fixed on the bottom of the rear casing 2 and is preferably provided with a tubular through sleeve 20, which projects from the bottom of the rear casing 2 towards the ribbon-like portion 4 of the front half-shell 3, remaining locally substantially perpendicular to the front half-shell 3, and is shaped so as to house the light-guide plate 6 and, optionally, part of the support base 10.

In the embodiment shown, furthermore, the support structure 19 is preferably made of an opaque plastic material, and is preferably manufactured by means of an injection moulding procedure.

The way in which the automotive lighting unit 1 works can easily be assumed from the description above and, therefore, does not require further explanations.

On the other hand, as far as the lighting assembly 5 is concerned, the light rays $r_3$, which come from the LED diode/s 12 and are directly directed towards the front sidewall 7 of the light-guide plate 6 (namely, are directed towards the front sidewall 7 without before bouncing on the lateral sidewall 13 of the light-guide plate 6), reach the transversal groove 15 with an angle of incidence that is greater than the limit angle and, therefore, are reflected towards the lateral sidewall 13 of the light-guide plate 6. Instead, the light rays $r_2$, which are reflected by the lateral sidewall 13 of the light-guide plate 6, reach the transversal groove 15 with an angle of incidence that is smaller than the limit angle and, therefore, manage to cross the transversal groove 15 and reach the front sidewall 7 of the light-guide plate 6.

The advantages related to the special structure of the lighting assembly 5 are numerous.

First of all, the presence of the transversal groove 15 on the face of the light-guide plate 6 allows manufacturers to eliminate excess lighting of the section/segment of the front sidewall 7 of the light-guide plate 6 adjacent to the vertex 16 of the light-guide plate 6, thus allowing the light streaming out of the light-guide plate 6 to be uniform along the entire length of the front sidewall 7 of the plate.

In addition, the stepped profile of the lateral sidewall of the light-guide plate 6 allows manufacturers to minimize the extension of the sector of the light-guide plate 6 delimited by the end segment 8*b* of the rear sidewall 8 of the light-guide plate 6, by the lateral sidewall 13 of the light-guide plate 6 and, finally, by the transversal groove 15, with a reduction of the overall dimensions of the automotive lighting unit 1 deriving therefrom.

Finally, it is clear that the automotive lighting unit 1 described above can be subjected to changes and variations, without for this reason going beyond the scope of protection of the invention.

For example, in a different embodiment, the oblong light source could comprise, instead of the LED diodes 9: a light-guide bar of photoconductive material, preferably made of a transparent plastic material, which extends inside the rear casing 2, grazing the segment 8*a* of the rear sidewall 8 of the light-guide plate 6; and one or more remote LED diodes, which are located in the area of one of the two ends of the light-guide bar, so as to direct the light produced inside the light-guide bar. The light-guide bar is structured so as to collect the light generated by the remote LED diode/s and convey it, in a known manner, inside the body of the light-guide plate 6, along the entire length of the segment 8*a* of the rear sidewall 8 of the light-guide plate 6.

The invention claimed is:

1. Automotive lighting unit (1) comprising a substantially basin-shaped rear casing (2) designed to be fixed onto the vehicle body; a front half-shell (3) which is arranged to close the mouth (2*a*) of the rear casing (2), and is provided with at least one transparent or semi-transparent portion (4); and at least a first lighting assembly (5) which emits light on command and is located inside the rear casing (2) so as to be able to backlight said transparent or semi-transparent portion (4) of the front half-shell (3);

the automotive lighting unit (1) being characterised in that the lighting assembly (5) comprises: at least one light-guide plate (6) made of photoconductive material, which is arranged inside the rear casing (2) with a front sidewall (7) of the plate facing said transparent or semi-transparent portion (4), and with a rear sidewall (8) of the plate facing the rear casing (2); a first oblong light source (9) which is located inside the rear casing (2) at a first segment (8*a*) of said rear sidewall (8), and is designed to direct the light produced inside the light-guide plate (6) so that said light travels inside the body of the light-guide plate (6) towards said front sidewall (7); and a second light source (12) which is located inside the rear casing (2) at a second segment (8*b*) of the rear sidewall (8) complementary to said first segment (8*a*), and is designed to of direct the light produced inside the light-guide plate (6), so that this light travels inside the body of the light-guide plate (6) toward a first lateral sidewall (13) of the light-guide plate (6) connecting the second segment (8*b*) of the rear sidewall (8) of the light-guide plate (6) to the front sidewall (7) of the same light-guide plate (6);

the light-guide plate (6) also being provided with a transversal groove (15) that extends along one of the two faces of the light-guide plate (6), from the front sidewall (7) of the light-guide plate (6) toward the rear sidewall (8) of the light-guide plate (6), so as to be interposed between said first lateral sidewall (13) of the plate and the front sidewall (7) of the plate, and be crossed by the light (r2) reflected by said first lateral sidewall (13) of the light-guide plate (6) towards the front sidewall (7) of the light-guide plate (6); said transversal groove (15) being also designed to reflect, far from the front sidewall (7) of the light-guide plate (6), the light (r3) coming directly from said second light source (12) and directed towards the front sidewall (7) of the light-guide plate (6).

2. Automotive lighting unit according to claim 1, characterised in that said transversal groove (15) starts from the front sidewall (7) of the light-guide plate (6) at the vertex (16) of the light-guide plate (6) formed by the front sidewall (7) and by the first lateral sidewall (13) of the light-guide plate.

3. Automotive lighting unit according to claim 1, characterised in that said transversal groove (15) extends towards the joining point between the first (8*a*) and the second segment (8*b*) of the rear sidewall (8) of the light-guide plate (6).

4. Automotive lighting unit according to claim 1, characterised in that said transversal groove (15) is substantially rectilinear.

5. Automotive lighting unit according to claim 4, characterised in that said transversal groove (15) extends on the light-guide plate (6) with an angle of inclination ($\alpha$) greater than 60° with respect to a main optical axis of the lighting unit (L), which is arranged substantially parallel to the longitudinal axis of the vehicle when the automotive lighting unit (1) is placed on the vehicle body.

6. Automotive lighting unit according to claim 5, characterised in that said transversal groove (15) extends on the light-guide plate (6) while remaining substantially perpendicular to said main optical axis of the lighting unit (L).

7. Automotive lighting unit according to claim 1, characterised in that said transversal groove (15) has a depth always less than the thickness of the light-guide plate (6).

8. Automotive lighting unit according to claim 1, characterised in that said transversal groove (15) passes through the whole thickness of the light-guide plate (6).

9. Automotive lighting unit according to claim 1, characterised in that said first lateral sidewall (13) of the light-guide plate (6) has a stepped profile.

10. Automotive lighting unit according to claim 9, characterised in that the first segment (8*a*) of the rear sidewall (8) of the light-guide plate (6) is shaped/structured so as to collimate a part of the light rays (r1) coming from said first row of LED diodes (9) and directed towards the front sidewall (7) of the light-guide plate (6), in a direction substantially parallel to a main optical axis of the lighting unit (L), which is arranged substantially parallel to the longitudinal axis of the vehicle when the automotive lighting unit (1) is placed on the vehicle body.

11. Automotive lighting unit according to claim 1, characterised in that the first light source (9) comprises a first row of LED diodes (9), which are placed inside the rear casing (2) close to the first segment (8*a*) of the rear sidewall (8) of the light-guide plate (6), and are oriented so as to direct the light produced directly inside the body of the light-guide plate (6).

12. Automotive lighting unit according to claim 11, characterised in that the first segment (8*a*) of the rear sidewall (8) of the light-guide plate (6) is structured so as to collimate a part of the light rays (r1) coming from said first row of LED diodes (9) and directed towards the front sidewall (7) of the light-guide plate (6), in a direction substantially parallel to a main optical axis of the lighting unit (L), which is arranged substantially parallel to the longitudinal axis of the vehicle when the automotive lighting unit (1) is placed on the vehicle body.

13. Automotive lighting unit according to claim 1, characterised in that the second light sources comprises one or more LED diodes (12) which is/are placed inside the read casing (2) close to the second segment (8*b*) of the rear sidewall (8) of the light-guide plate (6), and is/are oriented so as to direct the light produced directly inside the body of the light-guide plate (6).

14. Automotive lighting unit according to claim 13, characterised in that the second light sources comprises a plurality of LED diodes (12) which are arranged spaced adjacent to one another to form a row of LED diodes (12) that extends at the side of said second segment (8*b*) of the rear sidewall (8) of the light-guide plate (6).

15. Automotive lighting unit according to claim 14, characterised in that the second segment (8*b*) of the rear sidewall (8) of the light-guide plate (6) is structured/shaped so as to collimate a part of the light rays (r2) coming from the LED diodes (12) and reflected towards the first lateral sidewall (13) of the light-guide plate (6), in a direction that intersects said first lateral sidewall (13) with an angle of incidence greater than the limit angle, so as to cause the total reflection of the light rays (r2) towards the transversal groove (15) and towards the front sidewall (7) of the light-guide plate (6).

16. Automotive lighting unit according to claim 1, characterised in that the transparent or semi-transparent portion (4) of the front half-shell (3) is substantially ribbon-like.

* * * * *